US009445456B2

(12) United States Patent
Donarski

(10) Patent No.: US 9,445,456 B2
(45) **Date of Patent: *Sep. 13, 2016**

(54) DUAL HEATING ELEMENT OF A COOKING APPLIANCE

(71) Applicant: Whirlpool Corporation, Benton Harbor, MI (US)

(72) Inventor: Robert S. Donarski, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 533 days.

This patent is subject to a terminal disclaimer.

(21) Appl. No.: 13/688,601

(22) Filed: Nov. 29, 2012

(65) Prior Publication Data

US 2013/0087548 A1 Apr. 11, 2013

Related U.S. Application Data

(62) Division of application No. 12/791,193, filed on Jun. 1, 2010, now Pat. No. 8,344,291.

(51) Int. Cl.

| | |
|---|---|
| ***H05B 3/68*** | (2006.01) |
| ***H05B 1/02*** | (2006.01) |
| ***F24C 15/10*** | (2006.01) |

(52) U.S. Cl.

CPC ..... *H05B 1/0202* (2013.01); *F24C 15/105* (2013.01)

(58) Field of Classification Search

CPC ..... F24C 15/102–15/106; H04B 1/0202; H05B 1/0258; H05B 3/68–3/688; H05B 4/748

USPC ..... 219/443.1–168.2

See application file for complete search history.

(56) References Cited

U.S. PATENT DOCUMENTS

| | | | | |
|---|---|---|---|---|
| 5,043,559 A * | 8/1991 | Scott | H05B 3/746 219/448.11 |
| 5,171,973 A * | 12/1992 | Higgins | 219/457.1 |
| 5,892,206 A * | 4/1999 | Higgins | 219/457.1 |
| 7,038,176 B2 * | 5/2006 | Sterling | 219/483 |
| 8,344,291 B2 * | 1/2013 | Donarski | 219/443.1 |

* cited by examiner

*Primary Examiner* — Sang Y Paik

(57) ABSTRACT

A cooking appliance including a plurality of separately controlled cooking areas, a first heating element positioned below one of the plurality of separately controlled cooking areas, a second heating element positioned below the same separately controlled cooking area as the first heating element, and an infinite switch electrically coupled with the first heating element and operable to energize the first heating element to supply heat to the separately controlled cooking area when the infinite switch is located at a first position. The switch has an operational tolerance, and the first heating element is sized such that the separately controlled cooking area is maintained below a target cooking temperature when the infinite switch is located at the first position and is operating at an upper limit of the operational tolerance.

9 Claims, 4 Drawing Sheets

DUAL HEATING ELEMENT OF A COOKING APPLIANCE

CROSS-REFERENCE TO RELATED APPLICATIONS

The present application represents a divisional application of U.S. patent application Ser. No. 12/791,193 entitled "Dual Heating Element of a Cooking Appliance" filed Jun. 1, 2010, pending.

TECHNICAL FIELD

The present disclosure relates generally to cooking appliances. The present disclosure relates more particularly to dual heating elements of cooking appliances.

BACKGROUND

A cooking appliance is used to cook meals and other foodstuffs on a cooktop or within an oven. The cooking appliance typically includes various control switches and electronics to control the heating elements of the cooking appliance.

SUMMARY

According to one aspect, a cooking appliance is disclosed. The cooking appliance includes a cooktop having a plurality of separately controlled cooking areas, a first heating element positioned below one of the plurality of separately controlled cooking areas, a second heating element positioned below the same separately controlled cooking area as the first heating element, and an infinite switch electrically coupled with the first heating element and the second heating element. The infinite switch is operable to energize the first heating element to supply heat to the separately controlled cooking area when the switch is located at a first position. The infinite switch has an operational tolerance. The first heating element is sized such that the separately controlled cooking area is maintained below a target cooking temperature when the infinite switch is located at the first position and is operating at an upper limit of the operational tolerance.

In some embodiments, the target cooking temperature may be approximately 200 degrees Fahrenheit. The first heating element may have a maximum power rating of approximately 300 Watts. Additionally, in some embodiments, the first heating element may be energized with electrical power equal to approximately eleven percent of the maximum power rating of the first heating element when the infinite switch is located at the first position and is operating at the upper limit of the operational tolerance.

In some embodiments, the second heating element may have a second maximum power rating of approximately 1000 Watts. In some embodiments, the infinite switch may include a first range of positions in which only the first heating element is energized and a range of positions in which both the first heating element and the second heating element are simultaneously energized. In some embodiments, the infinite switch may be further positionable in a home position in which both the first heating element and the second heating element are de-energized.

In some embodiments, the second heating element may be arranged non-concentrically with the first heating element. In some embodiments, the first heating element and the second heating element form a heating device that may have an outer diameter of six inches. In some embodiments, each of the first heating element and the second heating element may have a winding formed from coiled wire. Additionally, in some embodiments, the cooktop may be a glass-ceramic cooktop.

According to another aspect, the cooking appliance includes a cooktop having a plurality of separately controlled cooking areas, a heating device positioned below one of the plurality of separately controlled cooking areas, and an infinite switch. The heating device includes a first heating element having a first maximum power rating that is arranged non-concentrically with a second heating element having a second maximum power rating greater than the first maximum power rating. The infinite switch is electrically coupled with the first heating element and the second heating element. The infinite switch is also operable to energize the first heating element to supply heat to the separately controlled cooking area when the infinite switch is located at a first position. The switch also has an operational tolerance. The separately controlled cooking area is maintained below a target cooking temperature when the infinite switch is located at the first position and is operating at an upper limit of the switch operational tolerance.

In some embodiments, the first maximum power rating may be approximately 300 Watts and the second maximum power rating may be approximately 1000 Watts. Additionally, in some embodiments, each of the first heating element and the second heating element may have a winding formed from coiled wire. In some embodiments, the heating device may have an outer diameter of six inches.

According to another aspect, a cooking appliance includes a cooktop having a plurality of separately controlled cooking areas, a first heating element positioned below one of the plurality of separately controlled cooking areas, a second heating element positioned non-concentrically with the first heating element, and an infinite switch electrically coupled with the first heating element and the second heating element. The first heating element has a second winding formed from a first coiled wire and a first maximum power rating of approximately 300 Watts. The second heating element has a second winding formed from a second coiled wire and a second maximum power rating of approximately 1000 Watts. The infinite switch is operable to selectively energize the first heating element and the second heating element to supply heat to the separately controlled cooking area.

BRIEF DESCRIPTION OF THE DRAWINGS

The detailed description particularly refers to the following figures, in which.

DETAILED DESCRIPTION OF THE DRAWINGS

Figure 1:
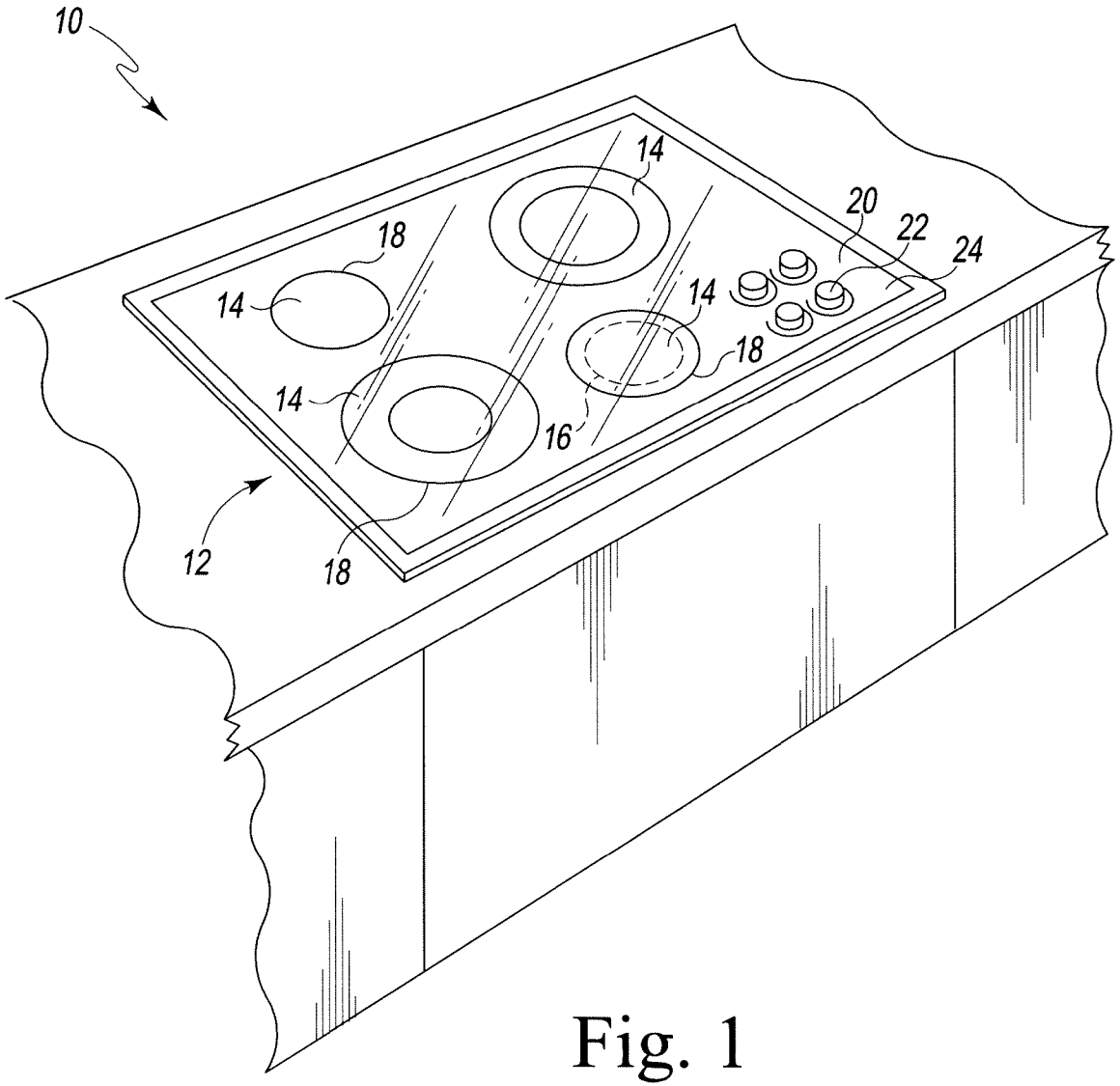
FIG. 1 is a perspective view of a cooking appliance.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a cooking appliance 10 is shown. The cooking appliance 10 includes a cooktop 12. As shown in FIG. 1, the cooktop 12 is a glass-ceramic cooktop. The cooktop 12 has a plurality of separately controlled cooking areas 14. It should be appreciated that the term "separately controlled cooking area" as used herein refers to a location or zone of the cooktop that may be operated by the user independently from the remainder of the cooktop. Each separately controlled cooking area may have a burner or other heating device dedicated to supplying heat to that area of the cooktop. The heat supplied to each separately controlled cooking area is controlled such that a command to change the heat supplied to it does not change the amount of heat supplied to any other separately controlled cooking area. In the illustrative embodiment of FIG. 1, the cooktop 12 has four separately controlled cooking areas 14.

A heating device 16 is positioned below each separately controlled cooking area 14. Each heating device 16 is operable to heat only the corresponding separately controlled cooking area 14 to desired cooking temperatures. An outer perimeter 18 designates to a user where the user should place pots, pans, and the like to be heated by each separately controlled cooking area 14.

The cooking appliance 10 also includes a control panel 20 positioned adjacent to the cooktop 12. A user may separately control the temperature of each of the plurality of separately controlled cooking areas 14 using a set of knobs 22 positioned on a top surface 24 of the control panel 20. As the user rotates one of the knobs 22, an infinite switch assembly 30 (see FIGS. 2 and 3) coupled to that knob 22 adjusts the heat generated by the corresponding heating device 16 to change the temperature of one of the plurality of separately controlled cooking areas 14.

Figure 2:
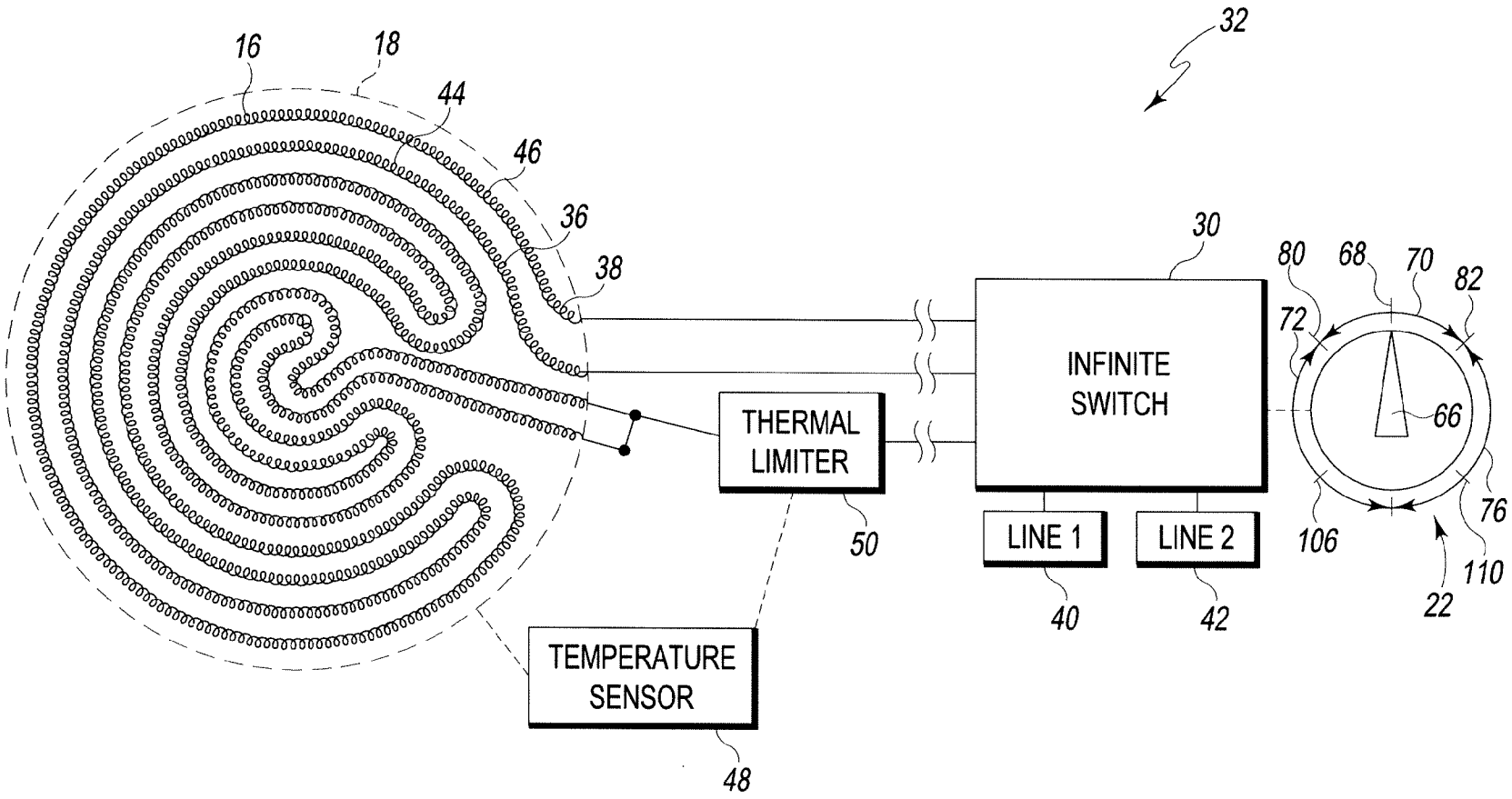
FIG. 2 is a simplified block diagram of one illustrative embodiment of a control system for the cooking appliance of FIG. 1.

Referring to FIG. 2, a simplified block diagram of an illustrative control system 32 for the cooking appliance 10 is shown. One of the heating devices 16, which is positioned below one of the separately controlled cooking areas 14, is shown in greater detail. As shown in FIG. 2, the heating device 16 has an outer diameter 34, which corresponds generally with the outer perimeter 18. The outer diameter 34 of the heating device 16 is approximately six inches. The heating device 16 includes a resistive heating element 36 and a resistive heating element 38. When energized with electrical power generated by an electrical power supply (not shown), each of the heating elements 36, 38 generates heat, which is supplied to the corresponding separately controlled cooking area 14 to raise the temperature of the cooktop 12. The infinite switch assembly 30 is positioned between the heating elements 36, 38 and electrical lines 40 ("Line 1"), 42 ("Line 2") of the electrical power supply. As will be discussed in greater detail, the infinite switch assembly 30 is operable to regulate the electrical power supplied to the heating device 16.

As shown in FIG. 2, the heating elements 36, 38 are arranged in a non-concentric manner such that each of the heating elements 36, 38 apply heat to substantially the entire separately controlled cooking area 14 when energized. In other embodiments (not shown), the heating elements may be arranged in substantially concentric circles. In such concentric heating devices, the heating elements will apply heat to only a specific portion (e.g., an inner or outer portion) of the corresponding separately controlled cooking area when energized. The heating elements 36, 38 define the outer diameter 34 of the heating device 16. As discussed above, the outer diameter 34 of the heating device 16 is approximately six inches; it should be appreciated that in other embodiments the heating elements 36, 38 may be larger or smaller such that the outer diameter 34 may be greater or lesser than that of the illustrative embodiment.

The heating elements 36, 38 have windings 44, 46, respectively, of highly resistive metallic wire that follow a convoluted path below the surface of the separately controlled cooking area 14. The windings 44, 46 may be formed from Nichrome 80/20, Kanthal, Cupronickel, or any other material having relatively high electrical resistance. The metallic wire of the windings 44, 46 has been coiled to increase resistance and thereby increase the maximum power rating of the heating elements 36, 38. In the illustrative embodiment, the resistance of the winding 44 of the heating element 36 is approximately 192 ohms. In the illustrative embodiment, the resistance of the winding 46 of the heating element 38 is approximately 57.6 ohms.

In the illustrative embodiment, the heating element 36 has a maximum power rating of 300 Watts, and the heating element 38 has a maximum power rating of 1000 Watts. As used herein, the term "maximum power rating" is defined as the maximum electrical power that can be dissipated by the resistive heating element. The maximum power rating is set or defined by the manufacturer of the resistive heating element and typically includes a margin of safety. For example, a heating element having a maximum power rating of 1000 Watts may be energized to a maximum power level of 1000 Watts. Thus, in the illustrative embodiment, when the heating elements 36, 38 are energized together to their respective maximum power levels, the heating device 16 generates a total of 1300 Watts.

The control system 32 includes a temperature sensor 48, which is operable to measure the temperature of the separately controlled cooking area 14. The measured temperature is relayed to a thermal limiter 50 coupled to the heating elements 36, 38. In some embodiments, the temperature sensor 48 and the thermal limiter 50 may be components of the heating device 16 that is installed below the separately controlled cooking area 14. When the measured temperature exceeds a specified temperature, the thermal limiter 50 is operable to deenergize the heating elements 36, 38 by severing the connection to the infinite switch assembly 30 and, thus, to the power supply. In this way, the thermal limiter 50 prevents the heating device 16 from subjecting the separately controlled cooking area 14 to temperatures that would damage the glass-ceramic cooktop 12. When the measured temperature drops below the specified temperature, the thermal limiter 50 reconnects the heating elements 36, 38 to the electrical power supply, thereby allowing the heating elements 36, 38 to generate and supply heat to the separately controlled cooking area 14.

Figure 3:
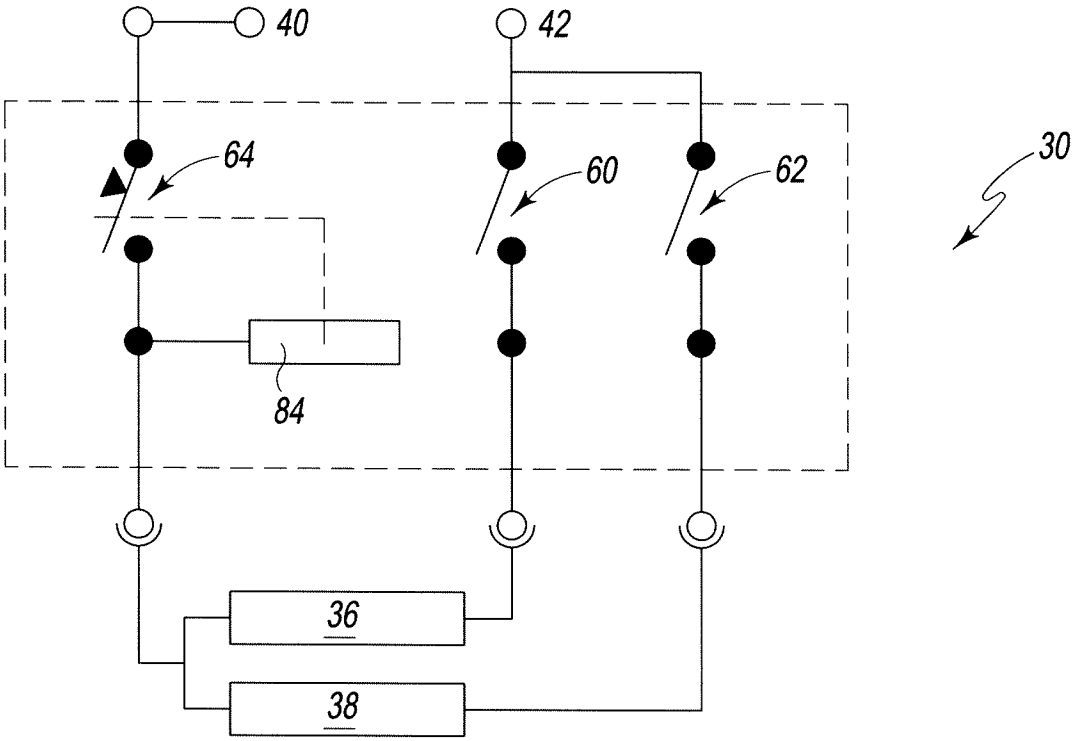
FIG. 3 is a simplified circuit diagram of the heating device and the infinite switch assembly of the control system of FIG. 2.

As shown in FIG. 3, the infinite switch assembly 30 includes several terminals that electrically couple with the heating elements 36, 38 and several terminals that electrically couple with lines 40, 42. The infinite switch assembly 30 includes primary switches 60, 62 and a secondary, cyclical switch 64. The switches 60, 62, 64 cooperate to selectively energize the heating elements 36, 38 and vary the amount of power supplied to each element. Varying the electrical power supplied to each of the heating elements 36, 38 changes the quantity of heat generated by each of the heating elements 36, 38 and, consequently, changes the temperature of the separately controlled cooking area 14.

The infinite switch assembly 30 is so-called because it may be positioned at a substantially infinite number of settings between 0 and 360 degrees. An exemplary embodiment of an infinite switch assembly is shown and described in U.S. Pat. No. 4,973,933, which is expressly incorporated herein by reference.

Returning to FIG. 2, the infinite switch assembly 30 is coupled to the knob 22 via a rotating shaft (not shown). The knob 22 includes a pointer 66 or other indicia that indicates the angular position of both the knob 22 and the infinite switch assembly 30. The angular position of the infinite switch assembly 30 determines whether the primary switches 60, 62 are opened or closed. When the primary switches 60, 62 are closed, the heating elements 36, 38 are connected with the electrical line 42, thereby permitting the heating elements 36, 38 to be energized with power.

As shown in FIG. 2, the knob 22 is shown in a home, or starting, position 68. At the home position 68, the primary switches 60, 62 are open and the heating elements 36, 38 are disconnected from the electrical line 42 such that no electrical power is supplied to either heating element. As shown in FIG. 2, the home position 68 is located in a range of switch positions associated with an unpowered zone 70 that encompasses approximately 90 degrees of the total angular travel of the knob 22. It will be appreciated that in other embodiments the unpowered zone 70 may be of different size.

When the knob 22 rotated out of the unpowered zone 70, the switches 60, 62 are selectively closed to connect the heating elements 36, 38 with the line 42. The knob 22 may be rotated in a clockwise (CW) manner, counter-clockwise (CCW) manner, or both, depending on the desired configuration. In the illustrative embodiment, rotating the knob 22 in a counter-clockwise manner moves the infinite switch assembly 30 from the unpowered zone 70 through another range of positions associated with one temperature adjustment zone 72 and an additional range of positions associated with another temperature adjustment zone 76. It will be appreciated that in other embodiments the temperature adjustment zones 72, 76 may be of differing sizes and the knob 22 may also have additional temperature adjustment zones.

When the knob 22 (and, consequently, the switch assembly 30) is located at any of the positions within the temperature adjustment zone 72, the infinite switch assembly 30 permits power to be supplied only to the heating element 36. For example, at a position 80 of the temperature adjustment zone 72, the switch 60 is closed and the heating element 36 is connected with the electrical line 42. At the position 80 or any other angular position in the zone 72, the switch 62 of the infinite switch assembly 30 remains open such that no power is supplied to the heating element 38. As shown in FIG. 2, the position 80 is located approximately 45 degrees from the home position 68. When the knob 22 is moved to another position 82, the switches 60, 62 are closed and the heating elements 36, 38 are connected with the line 42. In that way, electrical power may be supplied to both heating elements 36, 38 at position 82 of the temperature adjustment zone 76.

In addition to selectively energizing the heating elements 36, 38, the infinite switch assembly 30 varies the amount of power supplied to each of the heating elements 36, 38 in accordance with the position indicated by the knob 22. The secondary switch 64 of the infinite switch assembly 30 includes a bimetallic strip 84 that regulates the supply of power to the heating device 16 by changing shape in response to changes in temperature. For example, when either of the switches 60, 62 is closed, electric current is permitted to flow to the infinite switch assembly 30 and the heating device 16 via the electrical lines 40, 42. The electric current heats the bimetallic strip 84, causing the strip to change shape and thereby open the secondary switch 64. When the secondary switch 64 is open, the connection between the heating elements 36, 38 and the line 40 is severed and the heating elements 36, 38 are deenergized. After the bimetallic strip 84 has cooled, the bimetallic strip 84 returns to its initial shape, permitting the secondary switch 64 to close and reconnect the heating elements 36, 38 to the line 40. In that way, the secondary switch 64 operates in a cyclical manner between the closed ("on") state and the open ("off") state.

A desired temperature is achieved at the separately controlled cooking area 14, not by altering the voltage applied to the heating device 16, but instead by cycling between "on" and "off" states. Through the cyclic ratio (i.e., the respective length of the "on" and "off" times), an average power is supplied to energize the heating elements 36, 38. In the illustrative embodiment, increasing rotation of the knob 22 in the counter-clockwise direction permits the secondary switch 64 to remain closed for progressively longer time intervals, increasing the average power supplied to the heating elements 36, 38 from zero percent at the home position 68 to one hundred percent at the position 82.

Because the response of the bimetallic strip 84 to temperature changes varies during operation, the amount of electrical power supplied by the infinite switch assembly 30 may fluctuate within an operational tolerance. The term "operational tolerance" is defined herein as the range over which electrical power supplied to the heating device is permitted to vary from the expected or nominal power level. The operational tolerance extends from a lower limit to an upper limit. When the bimetallic strip 84 causes the infinite switch assembly 30 to operate at the lower limit of the operational tolerance, the average power supplied to the heating device is less than the nominal power level. When the infinite switch assembly 30 is operating at the upper limit of the operational tolerance, the average power supplied to the heating device is greater than the nominal value. For example, at a particular angular position of the knob 22, the bimetallic strip 84 may be slower to change shape in response to being heated, thereby keeping the secondary switch 64 closed for a longer time interval than expected and resulting in more power being supplied to the heating device 16. In the illustrative embodiment, the operational tolerance of the infinite switch assembly 30 is approximately plus or minus five percent of the nominal power level.

Figure 4:
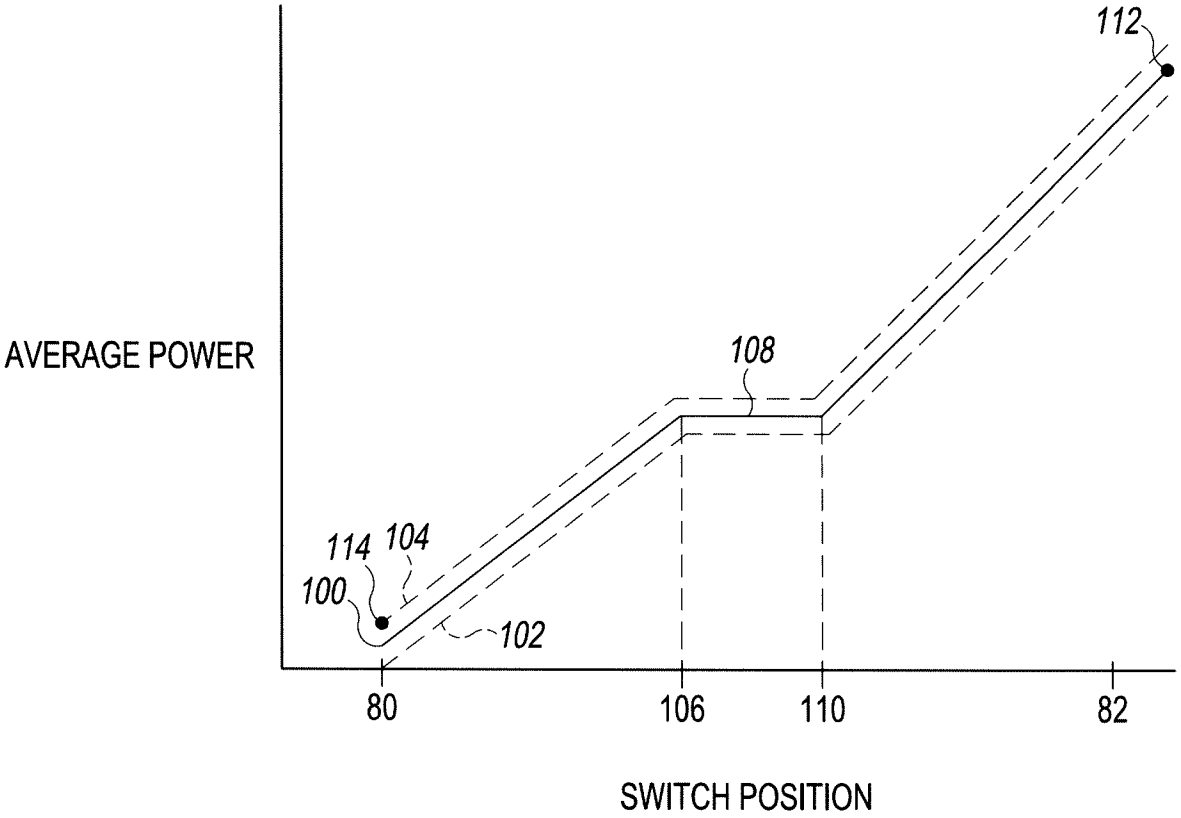
FIG. 4 is graph of the average power supplied to the heating device of FIG. 2 as a function of infinite switch position.

Referring now to FIG. 4, when the knob 22 indicates that the infinite switch is located at the position 80 in the temperature adjustment zone 72, the infinite switch assembly 30 energizes the heating element 36 at a first power level 100, and the heating element 36 begins supplying heat to the separately controlled cooking area 14. In the illustrative embodiment, the secondary switch 64 is designed to cycle between the "on" and "off" states such that the first power level 100 supplied to heating element 36 is approximately six percent of the maximum power rating of the heating element 36. Due to the operational tolerance of the infinite switch assembly 30, the first power level 100 may vary between the lower limit of one percent and the upper limit of eleven percent. Imaginary lines 102 and 104 indicate the lower limit and upper limit, respectively, of the operational tolerance over the range of switch positions.

As discussed above, the maximum power rating of the heating element 36 is 300 Watts. The maximum power rating is selected to ensure that the temperature of the separately controlled cooking area 14 is less than a target cooking temperature when the infinite switch assembly 30 is located at the position 80. The "target cooking temperature" is defined herein as the industry-recognized average temperature at which a particular food item should be maintained to achieve industry-acceptable cooking performance. For example, the target cooking temperature for one particular type of baker's chocolate is approximately 200 degrees Fahrenheit, which is the temperature at which chocolate is maintained in a liquid state without scorching or drying out. Other food items, such as, for example, egg-based sauces, puddings, or sauces using starch or flour as a thickener may have approximately the same target cooking temperature or different target cooking temperatures. Sources of criteria for industry-acceptable cooking performance for particular food times may be the Consumers Union. In the illustrative embodiment, the target cooking temperature is 200 degrees F. when the infinite switch assembly 30 is located at the position 80. If the switch assembly 30 is operating at the upper limit of the operational tolerance (i.e., nominal+5%), the heating element 36 is energized with eleven percent of the maximum power rating of the heating element 36, or approximately 33 Watts, as indicated by point 114 on the line 104 shown in FIG. 4. When supplied with 33 Watts of average power, the heating element 36 maintains the temperature of the separately controlled cooking area 14 at or below 200 degrees F.

As the knob 22 is rotated from the position 80 to another position 106 within the temperature adjustment zone 72, the infinite switch assembly 30 increases the power supplied to the heating element 36. The secondary switch 64 is permitted to remain closed for progressively longer time intervals, thereby increasing the power supplied to the heating element 36 to a second power level 108. In the illustrative embodiment, the second power level 108 is approximately the maximum power rating of heating element 36 (i.e., 300 Watts).

When the knob 22 is moved to a position 110 of the temperature adjustment zone 76, the infinite switch assembly 30 energizes both heating elements 36, 38 with power and both heating elements 36, 38 supply heat to the separately controlled cooking area 14. At position 110, the infinite switch assembly 30 is configured to divide the electrical power between the heating elements 36, 38. The sum of the electrical power supplied to both heating elements 36, 38 is approximately equal to the second power level 108 and both heating elements 36, 38 are operated at less than their respective maximum power ratings at the position 110.

As the knob 22 is rotated from the position 110 to the position 82, the infinite switch assembly 30 increases the power supplied to both heating elements 36, 38 such that additional heat is supplied to the separately controlled cooking area 14. That influx of additional heat raises the temperature of that separately controlled cooking area 14. The total power supplied to the heating elements 36, 38 increases to a third power level 112 when the knob 22 reaches the position 82. In the illustrative embodiment, the third power level 112 is equal to the sum of the maximum power ratings of the heating elements 36, 38; in other words, the third power level 112 is approximately 1300 Watts.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A cooking appliance comprising:

a cooktop including a plurality of separately controlled cooking areas;

a first heating element positioned below one of the plurality of separately controlled cooking areas, the first heating element having a second winding formed from a first coiled wire and a first maximum power rating of approximately 300 Watts, wherein the first heating element is configured to supply heat to the separately controlled cooking area;

a second heating element positioned non-concentrically with the first heating element, the second heating element having a second winding formed from a second coiled wire and a second maximum power rating of approximately 1000 Watts, wherein the second heating element is configured to supply heat to the separately controlled cooking area;

an infinite switch electrically coupled with the first heating element and the second heating element and operable to selectively energize the first heating element and the second heating element to supply heat to the separately controlled cooking area, wherein the infinite switch includes a first primary switch associated with the first heating element and a second primary switch associated with the second heating element, and further wherein the infinite switch includes a secondary switch associated with both the first and second heating elements and operable between open and closed positions; and first and second electric lines electrically coupled to the infinite switch and configured to provide electric current to the infinite switch, wherein electric current to the first and second heating elements is controlled by the infinite switch through the first and second electric lines, wherein the first and second primary switches of the infinite switch are disposed on the second electric line for selectively powering the first and second heating elements, and further wherein the secondary switch is disposed on the first electric line for selectively powering the first and second heating elements in the closed position and de-energizing the first and second heating elements in the open position, wherein a temperature provided by the electric current of the first electric line determines the position of the secondary switch.

2. The cooking appliance of claim 1, wherein the first heating element and the second heating element form a heating device having an outer diameter of six inches.

3. The cooking appliance of claim 1, wherein the infinite switch further includes a home position in which both the first heating element and the second heating element are de-energized.

4. The cooking appliance of claim 1, further comprising a control system having a temperature sensor, the temperature sensor configured to measure the temperature of the separately controlled cooking area.

5. The cooking appliance of claim 4, further comprising a thermal limiter, the thermal limiter is coupled to at least one of the first and second heating elements and is configured to receive a signal from the temperature sensor to de-energize the first and second heating elements when a the measured temperature exceeds a predetermined temperature.

6. The cooking appliance of claim 1, wherein the switch has an operational tolerance, and the separately controlled cooking area is maintained below a target cooking temperature when the infinite switch is located at a first position and is operating at an upper limit of the operational tolerance.

7. The cooking appliance of claim 6, wherein the target cooking temperature is approximately 200 degrees Fahrenheit.

8. The cooking appliance of claim 1, including:

a bimetallic strip associated with the secondary strip of the infinite switch, the bimetallic strip operable between a first position wherein the secondary switch is in the closed position and a second position wherein the secondary switch is in the open position.

9. The cooking appliance of claim 8, wherein the bimetallic strip is moved from the first position to the second position based on the temperature provided by the electric current of the first electric line.

* * * * *